US006991400B1

(12) United States Patent
Negueloua

(10) Patent No.: US 6,991,400 B1
(45) Date of Patent: Jan. 31, 2006

(54) CAP SEALER FOR CAULKED JOINTS

(76) Inventor: Gerald I. Negueloua, 317 Dorset St., Slidell, LA (US) 70458

( * ) Notice: Subject to any disclaimer, the term of this patent is extended or adjusted under 35 U.S.C. 154(b) by 578 days.

(21) Appl. No.: 09/784,693

(22) Filed: Feb. 15, 2001

(51) Int. Cl.
*E01C 11/02* (2006.01)

(52) U.S. Cl. ..... 404/56; 404/69; 52/396.04; 52/396.08

(58) Field of Classification Search ..... 14/73.1, 14/73.5; 404/47, 56, 64, 65, 67, 69; 52/393, 52/395, 396.04, 396.08, 396.1, 396.05
See application file for complete search history.

(56) References Cited

U.S. PATENT DOCUMENTS

| | | | | | |
|---|---|---|---|---|---|
| 2,016,968 | A | * | 10/1935 | Marble | 404/47 |
| 2,230,688 | A | * | 2/1941 | Irwin | 16/7 |
| 3,114,219 | A | * | 12/1963 | Bradley | 249/205 |
| 3,213,584 | A | * | 10/1965 | Bush | 277/641 |
| 3,352,217 | A | * | 11/1967 | Peters et al. | 404/65 |
| 3,508,369 | A | * | 4/1970 | Tennison | 52/396.08 |
| 3,760,544 | A | * | 9/1973 | Hawes et al. | 52/204.597 |
| D236,718 | S | * | 9/1975 | Patterson | 52/396.04 |
| 3,923,411 | A | * | 12/1975 | Berghman | 404/64 |
| 4,833,855 | A | * | 5/1989 | Winter, IV | 52/591.4 |
| 5,078,538 | A | * | 1/1992 | Montalbano | 404/9 |
| 5,088,260 | A | * | 2/1992 | Barton et al. | 52/416 |
| 5,197,819 | A | * | 3/1993 | Hughes | 404/13 |
| 5,211,506 | A | | 5/1993 | Manion | 404/87 |
| 5,460,115 | A | * | 10/1995 | Speer et al. | 116/63 P |
| 5,531,455 | A | * | 7/1996 | Calixto | 277/646 |
| 5,667,334 | A | * | 9/1997 | Boyce | 404/9 |
| 5,715,643 | A | * | 2/1998 | Parkinson | 52/656.9 |
| 5,857,802 | A | * | 1/1999 | Richter | 404/14 |
| 5,888,017 | A | * | 3/1999 | Corrie | 404/64 |
| 6,158,915 | A | * | 12/2000 | Kise | 403/2 |
| 6,161,353 | A | * | 12/2000 | Negola et al. | 52/453 |
| 6,170,214 | B1 | * | 1/2001 | Treister et al. | 52/511 |
| 6,219,982 | B1 | * | 4/2001 | Eyring | 52/393 |
| 6,228,507 | B1 | * | 5/2001 | Hahn | 428/542.2 |
| 6,253,514 | B1 | * | 7/2001 | Jobe et al. | 52/395 |

OTHER PUBLICATIONS

Standard Guide for Use of Elastomeric Joint Sealants; *Annual Bool of ASTM Standards*, vol. 04.07; Sep. 1986.
Why Sealant Joints Fail, Architecture/Dec. 1986.

* cited by examiner

*Primary Examiner*—Gary S. Hartmann
(74) *Attorney, Agent, or Firm*—Garvey, Smith, Nehrbass & North, L.L.C.; Gregory C. Smith

(57) ABSTRACT

An improved sealant cap which is comprised of a flexible material, preferably, but not necessarily made of lead or other material having the same properties of lead, having a first arm member which is inserted downward into the caulking material after the caulking material has been in place within the joint. The downward depending arm portion extends from a cap portion downward, so that as the arm member is pushed into the caulking material, the upper cap portion spans across the joint and rests on the adjoining stone members. There is further provided a plurality of ridges formed on the undersurface of the cap portion of the improved cap cover with the ridges increasing the area (by 50%) of the underside of the cap for the sealant to adhere to and the surface of the stone in such a manner as to prevent the cap from separating from the stone and insuring an elastic protection for the joints. In the preferred embodiment, the cap is constructed of material such as lead or other type of material having similar characteristics.

11 Claims, 3 Drawing Sheets

CAP SEALER FOR CAULKED JOINTS

CROSS-REFERENCE TO RELATED APPLICATIONS

Not applicable

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The apparatus of the present invention relates to sealing caulked joints. More particularly, the present invention relates to an improved cap for sealing a joint filled with sealant or caulking compound which adheres more firmly to the hard surfaces adjacent the joint.

2. General Background of the Invention

In the art of working with stone in order to construct a building or the like structure, it is imperative that the space between adjacent blocks of stone be filled with a caulking or sealant material so that there is a proper seal between the surfaces of the two adjacent stone or the like members. The use of caulking or sealant material for this purpose is well known in the art and has had a long history. In fact, there have been additional sealing procedures which are utilized in order to more effectively seal the joint. U.S. Pat. No. 5,211,506 discloses a backer rod tool which is utilized to insert material to a proper depth within the joint prior to placing the sealing or caulking material into the joint. In addition to this process, there has been in use for years a product known as Weathercap, which is a trademark owned by Weathercap, Inc., wherein following the cleaning, priming and placement of sealant or caulking into the joint, and the Weathercap is installed. The Weathercap is a flexible material, preferably, but not necessarily made of lead or other material having the same properties of lead which is inserted along the joint with edges of the cap resting on adjacent surfaces of the stone. The cap historically has been used to assist in maintaining the integrity of the joint preventing the intrusion of moisture.

One of the problems in the Weathercap which has been used over the years is the fact that the cap member was substantially a flexible material which simply rested on the top of the stones with little means for adherence in any manner to the edge of the block (stones) which it rested upon. Therefore, historically this Weathercap, although a marketable product, did not solve all of the problems, since it itself did not have sufficient means for securing it firmly to the stone in its own right, and therefore, did not fully protect the caulking or sealant compound. Therefore, there is a need in the art for a product which would greatly improve the ability of a sealed joint to withstand movement and prevent the capping member from separating from the stone as it has done in the past.

BRIEF SUMMARY OF THE INVENTION

The apparatus of the present invention solves the problems in a simple and straight forward manner. What is provided is an improved sealant cap which is comprised of a flexible material, preferably, but not necessarily made of lead or other material having the same properties of lead, having a first arm member which is inserted downward into the caulking material after the caulking material has been in place within the joint. The downward depending arm portion extends from a cap portion downward, so that as the arm member is pushed into the caulking material, the upper cap portion spans across the joint and rests on the adjoining stone members. There is further provided a plurality of ridges formed on the undersurface of the improved cap cover, these ridges increase (by 50%) the area of the underside of the cap for the sealant to adhere to and the surface of the stone in such a manner as to prevent the cap from separating from the stone and insuring an elastic protection for the joints. A second embodiment of the flat cap member includes an embodiment which is used as a "cove cap" to seal the surfaces of adjacent stones which have both a horizontal and vertical surface, with likewise the cove cap having the undersurface of the cap including a plurality of ridges for adhering to the stone in a similar manner.

Therefore, it is the principal object of the present invention to increase the area available for the sealant to adhere to, creating an improved cover for a joint which has been filled with sealant or caulking material adhering more firmly to the surface upon which it is placed, protecting it from moisture intrusion, puncture and vandalism, ultraviolet rays, chemicals, abrasion, extreme weather and dirt;

It is a further object of the present invention to provide an improved Weathercap product which can be used both on flat joints and on joints comprised of horizontal vertical surfaces, having an underside which has a plurality of ridges for adhering to the surface upon which it is placed and for improving the contact between the surface and the cap over a prolonged period of time;

It is a further object of the present invention to provide a Weathercap apparatus which includes a downward depending leg member, so that the masonry joint is reduced by one half when the Weathercap is inner posed in a joint between sealants;

It is a further object of the present invention to provide an improved Weathercap which remains flexible and will not tear or shear;

It is a further object of the present invention to provide a Weathercap which covers sealant, thereby prolonging life and preventing margin checking, and which is not a conductor of heat or cold;

It is a further object of the present invention to provide a Weathercap which resists corrosion, accepts paint thereupon, and resists mold attack on covered sealant in high humidity areas;

It is a further object of the present invention to provide a Weathercap which is made of a material which is low in tensile strength, hardness, elastic modulus and increased strength.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
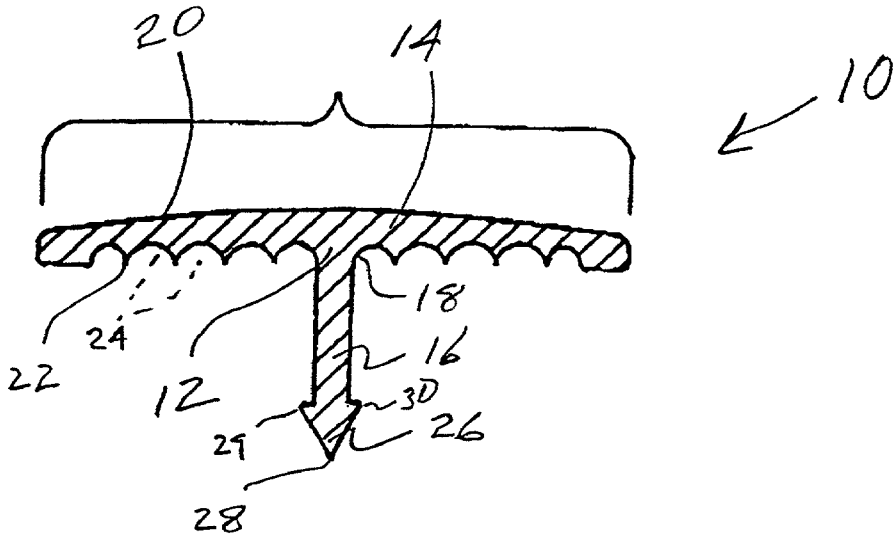
FIG. 1 is an overall view of the preferred embodiment of the apparatus of the present invention as utilized on a flat surface.

FIGS. 1–5D illustrate the preferred embodiment of the apparatus of the present invention by the numeral 10 and the method of installation thereof. As illustrated, for example, in FIG. 1, there is illustrated apparatus 10 which comprises a substantially flexible material 12 having an overall cap portion 14 with a leg portion 16 extending from the underside 18 of the cap portion 14. As illustrated in side view in FIG. 1, this embodiment of the apparatus would be used primarily for sealing flat surfaces between two stone components utilizing the present invention. As illustrated in FIG. 1, leg portion 16 extends from substantially a center point on the undersurface 18 of the cap portion 14 of apparatus 10. Wherein the upper face 20 of the cap 14 is flat, the undersurface 18 includes a plurality of ridges 22 which define a plurality of semicircular channels 24 there between, the purpose of which will be described further. As further illustrated, the leg member 16 also includes a terminating end portion 26 which is shaped substantially in an arrowhead shape having a lower depending point portion 28 and a pair of outward extending shoulders 29 and 30.

Figure 2:
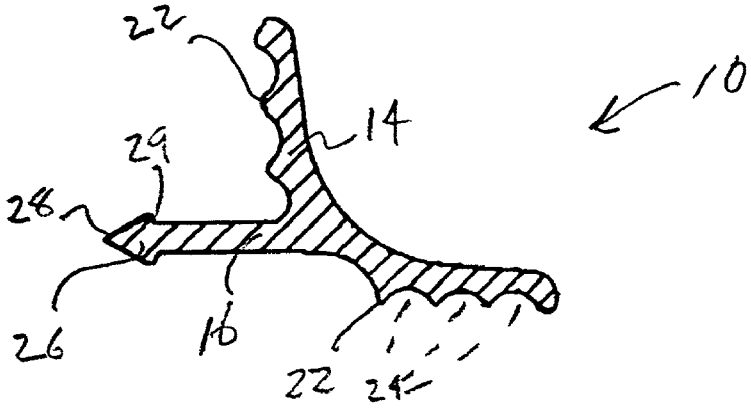
FIG. 2 is an overall view of the apparatus of the present invention as utilized on mating horizontal and vertical surfaces.
Figure 4:
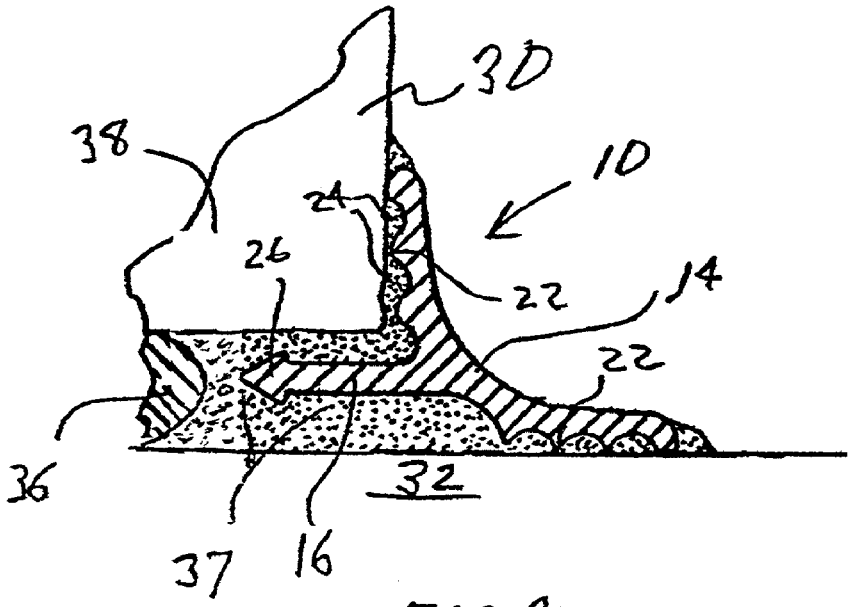

Turning now to FIG. 2, the cap apparatus 10 would be substantially the same type of apparatus as illustrated in FIG. 1 but for the fact that in this particular embodiment, the cap apparatus would be entitled a "cove" cap, which would be the type of cap utilized for mating of vertical and horizontal surfaces, as is more clearly seen in FIG. 4. Again, the components of the apparatus are identical and as seen by the view in FIG. 2. The cap apparatus 10 is flexible since it is comprised of high modulus type material such as lead or other type of material with similar characteristics, the cap is able to flex to allow movement while maintaining the integrity of the joint.

Figure 3:
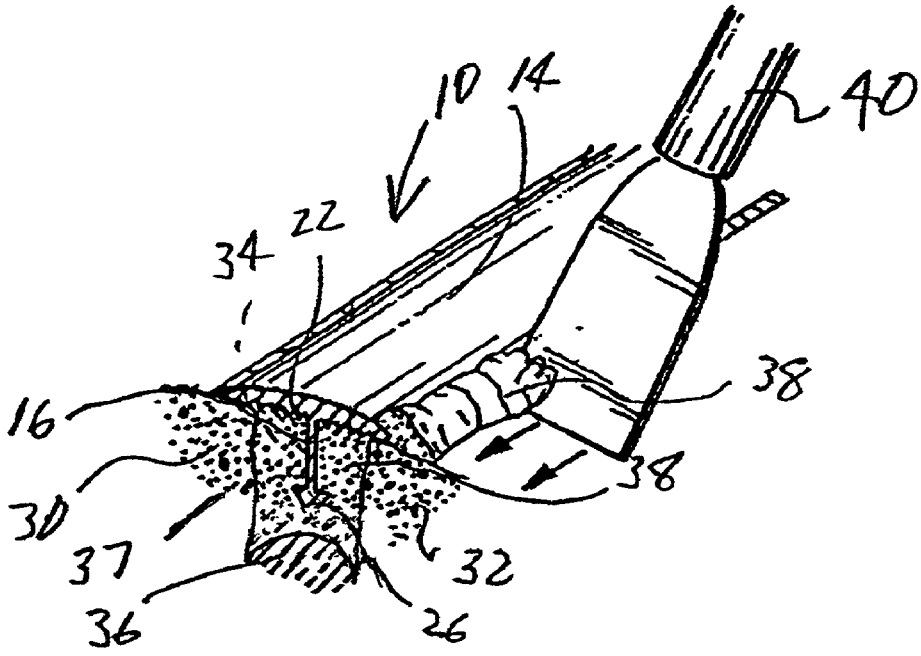
FIGS. 3 and 4 are views of the preferred embodiment of the apparatus of the present invention as utilized on flat and vertical arid horizontal surfaces respectively.

Turning now to FIG. 3, there is illustrated a view of the apparatus 10 as being positioned on a sealed joint. As illustrated, there is a pair of, for example, stones 30, 32 which are abutted against one another, forming a space 34 which must be sealed. This sealing of the space is normally accomplished with the first use of a backer rod or bond breaker tape 36 pushed down within the space 34 as seen in the process in FIGS. 5A–5B, leaving an upper portion 37 which must be sealed. This is normally done with the use of a sealing or caulking material 38 which as seen in FIG. 3, has been placed within the space 37 and filled. After the caulking material is in place and is still quite soft, the cap 10 would then be inserted down onto the space with the downward depending leg portion 16 of cap 10 being forced downward into the caulk so that the arrowhead portion 26 of the leg is embedded within the caulk and the plurality of ridges 22 are likewise forced into the caulk with the caulk also filling the semicircular channels 24 on the under face 18 of the cap portion 14. As also illustrated, the cap portion 14 is such a width that the end portions of the cap extend beyond the opening 37 and make contact with the upper surface of each of the stones 30, 32 wherein caulk would have been forced out of the space as the cap member is pushed on. Therefore, as the extra caulk 38 is being removed by a tool 40, the caulk would then be allowed to substantially dry so that the caulk would hold the cap 10 in place via the leg member 16 and the plurality of under ridges 22.

One feature of the improved Weathercap of the present invention is its ability to decrease the size of a joint by one half when the Weathercap is inserted into a joint filled with sealant. For example, if there were a joint between blocks, which may be ¾ inch in width, if one would simply attempt to seal such a joint, because the joint is more than ½ in width, the results would be "out of code". However, because the Weathercap of the present invention includes the downward depending leg portion 16, when the Weathercap is placed into the joint ¾ inch in width, the leg member 16 in effect transforms the single ¾ inch joint to two ⅜ inch joints separated by the leg member 16. Therefore, each "joint" being now ⅜ inches in diameter, is able to be sealed with conventional material. This feature, therefore, allows the improved Weathercap to seal a larger joint, and because of the plurality of ridges and channels on the underside, enables it to adhere to the sealant and seal the joints for a longer period of time.

Turning now to FIG. 4, there is substantially the same type of process that is taken place in relation to FIG. 3, however the cap 10 which is utilized in this particular embodiment is the "cove cap" because it is sealing a joint or an opening 37 between a vertical surface of block 30 and the horizontal surface of a lower block 32. As seen in this embodiment, the backer rod or bond breaker tape 36 has been placed within the opening 37. Caulking or sealant material 38 is then forced within the opening to extend outward beyond or along the vertical and horizontal surfaces out of the opening. The cap 10 is then inserted into the caulking with the leg 16 extending therein so that the caulking completely surrounds the leg 16, in particular the end portion 26 and the caulking fills the various semicircular channels 24 and is held in place via the ridges 22 of the cap member. The cap surface 14 is able to form a seal along between the vertical and horizontal surfaces. Also, because of the under ridges 22 and the channels 24 formed thereby, the cap will accomplish the same results of these joints as does the flat cap on joints formed by stones adjacent to one another.

Figure 5A:
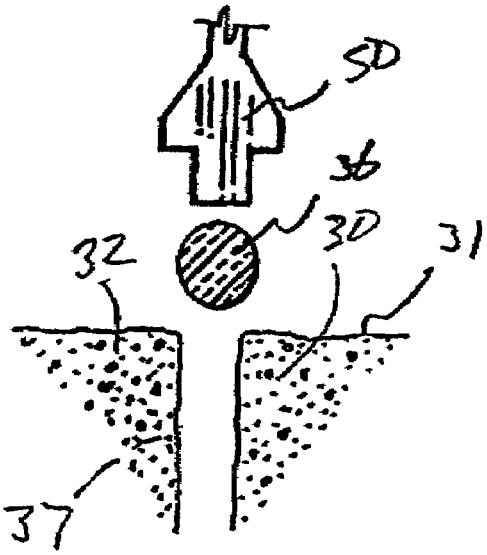
FIGS. 5A–5D illustrate sequential steps of the installation of the apparatus of the present invention during the caulking process.
Figure 5B:
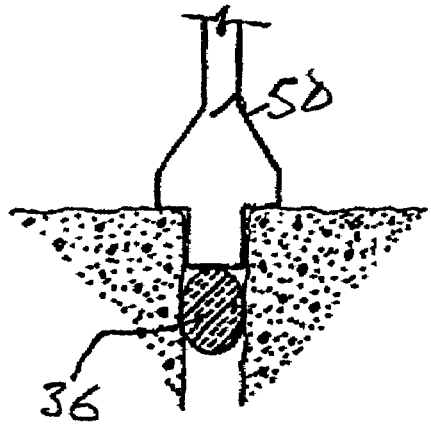
Figure 5C:
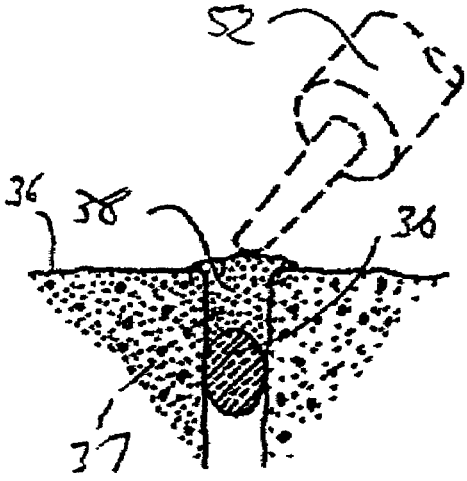
Figure 5D:
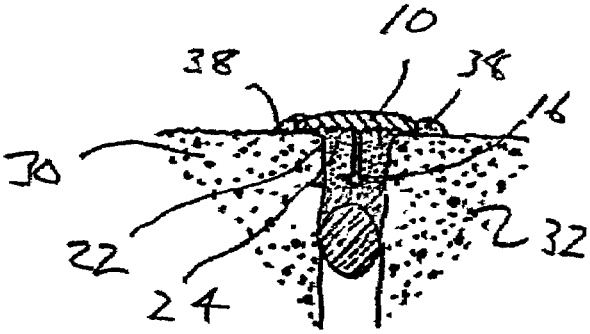

Reference is now made to FIGS. 5A–5D wherein there is seen a series of sequential steps for the process of sealing a joint between building blocks such as concrete or the like material. There is first included a pair of blocks 30, 32 forming a flat surface 31 and channel 37 there between. The joint is marked and masked for guidance. Next, a backer rod or bond breaker 36 is inserted down into the opening 37 via a tool 50 to a particular point as seen in FIG. 5B. The tool 50 is then removed, and the Weathercap 10 is prefit thereupon. The cap 10 is then primed and both top and sides of the joint are primed. Next, the caulking or sealant material 38 is placed within the opening 37 between the upper surface 31 of the blocks and the rod or tape member 36. In this particular embodiment, the caulking is being inserted from a caulking gun 52, as illustrated. After the caulking has been placed into the opening 37 to a point where there is excess caulking along the top surface of block 30, 32, the cap member 10 is then pressed downward into the position as was illustrated in FIG. 1. The excess caulking 38 would then be removed, and the caulking has filled the space around the leg members 16 and the various ridges 22 and semicircular channels 24. Therefore, the cap member would adhere to the caulk within the channel 37 and the overlapping edges of the cap 10, as the cap rests on the stones 30, 32 would also adhere to the caulking on the upper surface of the stones. This would form a strong and flexible protective seal between the outer ambient atmosphere and the sealed space 37. The joint is allowed to set for two days before the masking tape is removed. If the cap is to be painted, the masking tape is left in place and metal which is rubbed with vinegar (10% volume concentration), and primed with Sherwin & Williams galvite primer 631–5191 (or equivalent) which is then covered with latex flat paint.

Primarily because of the feature of the plurality of ridges which define a plurality of channels there between on the underside of the cap portion, this improved sealing cap for joints enables this improved product to adhere more firmly to the surfaces of the stone and the caulking there between. These features solve a problem which heretofore was plaguing the industry in that the inability of the old Weathercap product to maintain a seal between itself and the underlying surface caused by movement, resulting in loss of integrity of the joint and ultimately its failure, allowing seepage of moisture into the building.

Because of the properties of the Weathercap being constructed of material such as lead or other material having similar characteristics, if there is building movement, the low creep strength causes the lead or other suitable material to creep into the new configuration. Temperature change accelerates this creep movement. The low elastic modulus allows this process to continue indefinitely within the joint designed limits. Other metals would retain their original shape and permit moisture into the joints.

The foregoing embodiments are presented by way of example only; the scope of the present invention is to be limited only by the following claims.

I claim:

1. An improved cap for sealed joints between adjacent block, comprising:

a) a flexible body member, comprising a first substantially flat cap portion and a leg portion;

b) a plurality of ridges positioned across the entire underside of the flat cap portion contacting caulking sealant, the ridges defining a plurality of channels there between, the ridges further defining an increased area on the underside of the flat cap for the caulking sealant to adhere to;

c) the leg portion insertable into caulking sealant within the joint between the adjacent blocks, to a depth so that when the underside of the flat cap portion imbeds into the caulking sealant the plurality of ridges with the caulking sealant provide a sealed connection between the entire underside of the flat cap portion and the caulking sealant residing in the joint and on an upper surfaces of the adjacent blocks.

2. The improved cap in claim 1, wherein the cap is constructed of material having the characteristics of lead.

3. The improved cap in claim 1, wherein the leg member further comprises a pointed end having shoulder members for adhering within the sealant material.

4. The improved cap in claim 1, wherein the plurality of ridges and channels on the underside of the cap portion define a means for adhering to the fluidized sealant and the upper portion of the adjacent blocks for withstanding movement and preventing damage to the sealed joint.

5. The improved cap in claim 1, wherein the cap may be positioned to seal a joint between horizontal and vertical surfaces.

6. An improved cap for sealed joints between adjacent building members, comprising:

a) a flexible body member, comprising a first flat cap portion having a first smooth upper surface, an undersurface, and a leg portion extending down from the undersurface;

b) a plurality of ridges positioned across and contacting substantially the entire undersurface of the cap portion, defining a plurality of channels there between, the plurality of ridges and channels increasing the surface area on the underside of the cap by around 50% for caulking sealant to adhere to, thus strengthening the seal between the cap and the concrete or stone blocks the cap is set upon;

c) caulking sealant material placed within the joint between the adjacent building members;

d) the leg portion insertable into the caulking sealant material to a depth so that the underside of the flat cap portion imbeds into the caulking sealant material for providing a sealed connection between the underside of the cap and the caulking sealant material residing in the joint and on surfaces of the adjacent blocks.

7. The improved cap in claim 6, wherein the underside of the cap increases the area for the sealant to adhere to, improving bonding between the cap and the stones and strengthening the seal between the two.

8. The improved cap in claim 6, wherein the cap comprises a continuous strip or flexible material extending uninterrupted over the joint which needs to be sealed.

9. A method of sealing a joint between adjacent building blocks, comprising the following steps:

a) filling the joint with a caulking sealant material;

b) providing a cap, the cap having a flat cap portion and a downward depending leg portion;

c) inserting the leg portion down in to the caulking sealant material to a point that an underside of the flat cap portion makes sealing contact with the caulking sealant material;

d) providing a plurality of ridges on an underside of the flat cap and contacting the caulking sealant material across the entire underside of the cap, the ridges defining a plurality of channels there between, the ridges and channels increasing the area on the underside of the cap for the caulking sealant material to adhere to, improving the bond between the cap and the stones and strengthening the seal between the two.

10. The method in claim 9, further comprising the step of removing the excess sealant material from around the cap before the sealant completely sets.

11. The method in claim 9, the insertion of the leg portion of the cap down into the sealant material decreases the size of a joint by one half therefore defining two joint spaces, rather than a single space.

* * * * *